US009243449B1

(12) United States Patent
Ziemkowski et al.

(10) Patent No.: US 9,243,449 B1
(45) Date of Patent: Jan. 26, 2016

(54) AUTOMATED ENTRANCE

(71) Applicant: Z-Image, LLC, Firestone, CO (US)

(72) Inventors: Ted Ziemkowski, Firestone, CO (US); John Bonvallet, Boulder, CO (US); Devon Clark, Louisville, CO (US); Peeraya Nilwong, Firestone, CO (US)

(73) Assignee: Z Image, LLC, Firestone, CO (US)

( * ) Notice: Subject to any disclaimer, the term of this patent is extended or adjusted under 35 U.S.C. 154(b) by 0 days.

(21) Appl. No.: 14/327,205

(22) Filed: Jul. 9, 2014

(51) Int. Cl.

| | |
|---|---|
| ***E06B 11/08*** | (2006.01) |
| ***E05F 15/00*** | (2015.01) |
| ***E05F 17/00*** | (2006.01) |
| ***E06B 3/36*** | (2006.01) |
| ***E06B 5/00*** | (2006.01) |
| ***E05B 65/00*** | (2006.01) |
| ***E05B 47/00*** | (2006.01) |
| ***E05G 5/00*** | (2006.01) |
| ***E05F 1/00*** | (2006.01) |

(52) U.S. Cl.
CPC ..... *E06B 11/08* (2013.01); *E05B 47/00* (2013.01); *E05B 65/0007* (2013.01); *E05F 1/002* (2013.01); *E05F 15/00* (2013.01); *E05F 17/00* (2013.01); *E05G 5/00* (2013.01); *E06B 3/36* (2013.01); *E06B 5/00* (2013.01); *E06B 11/085* (2013.01); *E05F 2017/008* (2013.01)

(58) Field of Classification Search
CPC ..... E06B 11/08; E06B 11/085; E06B 7/36; E06B 7/362; E06B 3/36; E06B 5/00; E05G 5/00; E05F 1/002; E05F 17/00; E05F 15/00; E05B 65/0007; E05B 47/00
USPC ..... 49/46, 45, 44, 42
See application file for complete search history.

(56) References Cited

U.S. PATENT DOCUMENTS

| | | | | | |
|---|---|---|---|---|---|
| 1,434,180 | A * | 10/1922 | Woytassek | 194/271 |
| 1,914,237 | A * | 6/1933 | Blanchard | 49/44 |
| 1,965,449 | A * | 7/1934 | Blanchard | 49/44 |
| 2,025,958 | A * | 12/1935 | Schreiber | 49/44 |
| 4,565,030 | A * | 1/1986 | LaSance | 49/44 |
| 5,845,692 | A * | 12/1998 | Kellem et al. | 160/118 |
| 8,674,805 | B2 * | 3/2014 | Charych | 340/5.7 |
| 2002/0050098 | A1 * | 5/2002 | Chan | 49/42 |
| 2010/0088962 | A1 * | 4/2010 | McRoskey | 49/303 |
| 2014/0096447 | A1 * | 4/2014 | Harucksteiner et al. | 49/31 |

FOREIGN PATENT DOCUMENTS

| | | | | |
|---|---|---|---|---|
| CA | 2135939 | C * | 2/1999 | |
| CH | 660768 | A5 * | 6/1987 | E06B 3/90 |
| DE | 202013008332 | U1 * | 2/2015 | |
| FR | 2534963 | A1 * | 4/1984 | E06B 11/085 |

* cited by examiner

*Primary Examiner* — Katherine Mitchell
*Assistant Examiner* — Marcus Menezes
(74) *Attorney, Agent, or Firm* — Arent Fox LLP

(57) ABSTRACT

An automated entrance device includes a housing and a first and second panel operably coupled to the housing. The panels are positioned approximately at a 90° angle to each other. The first panel and the second panel rotate together from a first position to a second position to allow entrance to a user. After allowing a user to enter, the panels reset to the first position ready to selectively allow entrance to additional users.

17 Claims, 10 Drawing Sheets

Open Position

Partially Open Position

Reset Position

Open Position

Partially Open Position

Reset Position

AUTOMATED ENTRANCE

BACKGROUND

1. Field

Aspects of the present disclosure relates generally to an automated entrance and/or exit.

2. Description of the Related Art

In order to manage the flow of people through a turnstile, e.g., at an attraction or event, often an attendant must stand near the attraction to take a participant's ticket and allow them entrance to the attraction. An automated system that takes a form of payment and allows access, e.g., via a turnstile, may provide easier access to certain attractions, without requiring an attendant to be present. However, typical tripod style turnstiles are deficient in controlling access for younger participants. For example, younger participants may duck under such turnstiles. Additionally, children may climb, play, and/or hang on such turnstiles.

Thus, a need exits for an automated system that controls access to attractions in a better manner.

SUMMARY

In an aspect of the disclosure, a modified turnstile or automated entrance is provided. An automated entrance device may include a housing and a first and second panel operably coupled to the housing. The panels may be positioned approximately at a 90° angle to each other. The first panel and the second panel may rotate together from a first position to a second position to allow entrance to a user. After allowing a user to enter, the panels may reset to the first position, so as to be ready for allowing entrance to additional users.

Aspects may further include an emergency exit feature that allows the first panel to collapse against the second panel in order to allow a person to exit, while continuing to prevent unauthorized persons from entering. Pinch guards may be provided to prevent injury as the panels rotate, fold, pivot, hinge, etc.

The panels may comprise a solid panel that provides solid coverage of at least a portion of the entrance. The panels may comprise a clear material that allows users to see through the panels.

Magnetic or other similarly functioning latches may be used to allow the panels to pivot, to allow for an emergency exit, to act as an exit release, and to serve for general use purposes in the automated entrance. Sensors may be used with the magnetic or similarly functioning latches, including a delay that to provide for a smooth user exit.

A raised tread plate may be included that provides a covered area, such as for cables, power lines, and other connectors.

A multi-person mode may be provided that allows the entrance to cycle a certain number of times to allow entrance to multiple persons. For example, a magnet may be provided on a pivot, the magnet being sensed by a fixed Hall effect sensor. The sensor detects the magnet as it swings past the sensor, along with the panels, to indicate that a person has entered the attraction. The magnet may be positioned on the pivot and be movable to adjust the trip point.

Additional advantages and novel features of aspects of the present invention will be set forth in part in the description that follows, and in part will become more apparent to those skilled in the art upon examination of the following or upon learning by practice thereof.

DETAILED DESCRIPTION

Figure 1:
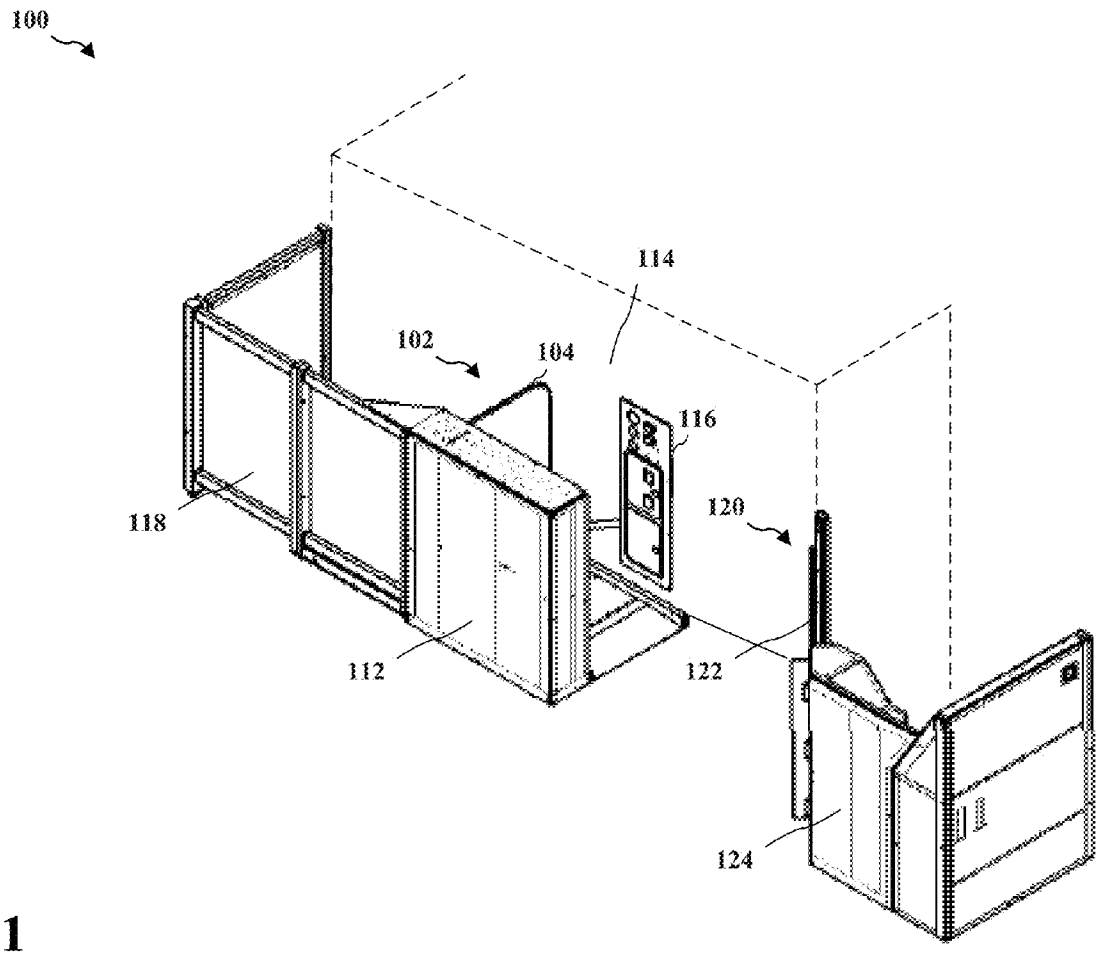
FIG. 1 is a diagram illustrating an example attraction having an automated entrance and an automated exit, in accordance with aspects of the present invention.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

Aspects presented herein include an automated entrance, also referred to herein as a modified turnstile, which may be used, e.g., to control access to an attraction. Among other types of attraction, the modified turnstile may control access for attractions that require an uninterrupted period of time within the attraction to allow a participant to fully experience the attraction. One example of such an attraction is a laser maze with a web of lasers through which a participant must navigate while avoiding touching any lasers. The entrance control may be useful for a timed event, for example, such as to encourage participants to move through the attraction quickly but carefully. The final score may be based, e.g., on time and penalties for crossing any of the laser beams. As typical participants may be young, controlling entrance to the attraction may be advantageous for some example applications.

Although controlled access to the attraction may be accomplished by an attendant who explains the system and helps to manage the flow of participants into the attraction, at times it may be beneficial to have a self-run or auto-attended attraction.

An automated system may be provided that accepts a form of payment or credit in exchange for entrance into the attraction. In addition to automated acceptance of payment/credit, such attractions may also require automated control of the flow of participants through the attraction. A standard tripod style turnstile may not provide such control, especially for younger participants who may circumvent the tripod by ducking underneath the tripod. Additionally, younger participants may play on the tripod, such as by climbing and/or hanging on the bars of the turnstile.

A sliding gate type example turnstile that has two doors that slide together may prevent participants from entering until a payment is made, but might allow participants to follow each other into the attraction, e.g., tailgate one another.

Rotating doors in another example may control the flow of people through an entrance. However, such doors may require a relatively larger amount of space. The overall footprint of the attraction, including the automated entry feature may need to be minimized in order to efficiently use the overall space allotted to a number of attractions, depending on the implementation.

Aspects presented herein include a new, modified turnstile system that provides automated access to an attraction, while controlling the flow of participants in an efficient use of space. The turnstile may comprise two panels arranged substantially perpendicularly (e.g., about +/−5° of a 90° angle therebetween) to each other, e.g., in an approximate "L" shape. FIGS. 2-7 illustrate aspects of example implementations having two panels mounted to substantially form, e.g., an "L shape" or an approximately right angle.

The modified turnstile may model, e.g., an attendant reaching out to allow a single participant to enter the attraction, while holding out the other arm to prevent the next person from entering. The panel may extend from a position near the floor to a height that would block the average participant from entering the attraction. This height may be, e.g., at least to height equivalent to the waist height of an average participant. This full door panel design may be configured to restrain participants, for example children, from ducking under and climbing over the door to gain unauthorized access to the attraction.

Once a credit or other entrance validation item is provided (e.g., to a reader of such item), the panel may be released so as to pivot to allow a first participant to enter the attraction. The second panel may also rotate along with the first panel, thereby preventing a second participant from entering with the first participant. Once the first participant passes through the automated entrance, also interchangeably referred to herein as a modified turnstile, the two panels may return to their original position, such as by pivoting or rotating back to the original position. Thus, the panel may reset itself in preparation for allowing entrance to other participants and lock therebetween, so as to prevent being pushed open by a person attempting to gain unauthorized entrance.

In order to allow for emergency exit, one of the panels may be hinged to allow it to fold back to form an exit. The normal position of this panel may be maintained, e.g., using a second magnetic latch, until a person attempts to exit the attraction.

FIG. 1 is a diagram illustrating an example system 100 comprising an automated entrance 102, in accordance with aspects of the present invention. The automated entrance 102 in FIG. 1 includes a first panel 104 and a second panel 106 (although not visible in FIG. 1 due to the orientation of the view of FIG. 1, the second panel may be seen in FIGS. 2-5). The first panel 104 and the second panel 106 start in a first position, in which the first panel 104 blocks the entrance opening. The entrance opening may be an opening formed between a pivot housing 112 and a second wall 114, for example, as shown in FIG. 1. The second wall 114 may be a wall of an attraction, a gate, or any other second closure that restricts access to the attraction, for example. Dashed lines are used in the figures to illustrate example attraction areas. Aspects of the automated entrance may be used with attractions of any suitable size and configuration.

A payment interface 116 may be provided to receive payment or credit for the attraction. For example, such a payment interface 116 may comprise any of a token machine, a card swipe interface, a bill validator, etc. Among others, a form of credit or payment for the attraction may include any of credits, credit or debit cards, tokens, coins, cash, and tickets.

Once a form of payment is received from a user, the first panel 104 and the second panel 106 may rotate together to a second position, in order to allow entrance to a user. A user is also referred to interchangeably herein as a "player" or "participant." Although the automated entrance may be configured to mechanically rotate the panels to allow entrance to a user, in one example, once a user has entered payment, a latch may be unlocked, in order to allow the user to push the first panel open to gain entrance to the attraction. As the user rotates the first panel by pushing it open, the second panel may move in concert with the first panel to follow behind the user and block access to any additional people.

The first panel 104 and the second panel 106 may rotate in a fixed manner relative to each other, remaining at an approximate 90 degree angle relative to one another. Once the user passes through the entrance, the panels 104, 106 may return to the first position, resetting the automated entrance so that the first panel 104 closes the entrance opening. Therefore, the automated entrance resets to the first position in preparation for allowing entrance to other participants. At this point, the panels may lock in the reset position to prevent another person after the first user who has entered from pushing the panel open to gain entrance to the attraction. The panels may lock, e.g., by using a magnet lock. FIG. 1 shows an example wall or other feature 118 that may extend from the housing 112 to block access to the attraction. Although the automated entrance may be configured to also operate as an exit, an attraction may be provided with a separate exit 120. The exit may comprise an exit housing 124 and an exit panel 122, aspects of which are described in additional detail in connection with FIG. 4.

Figure 2:
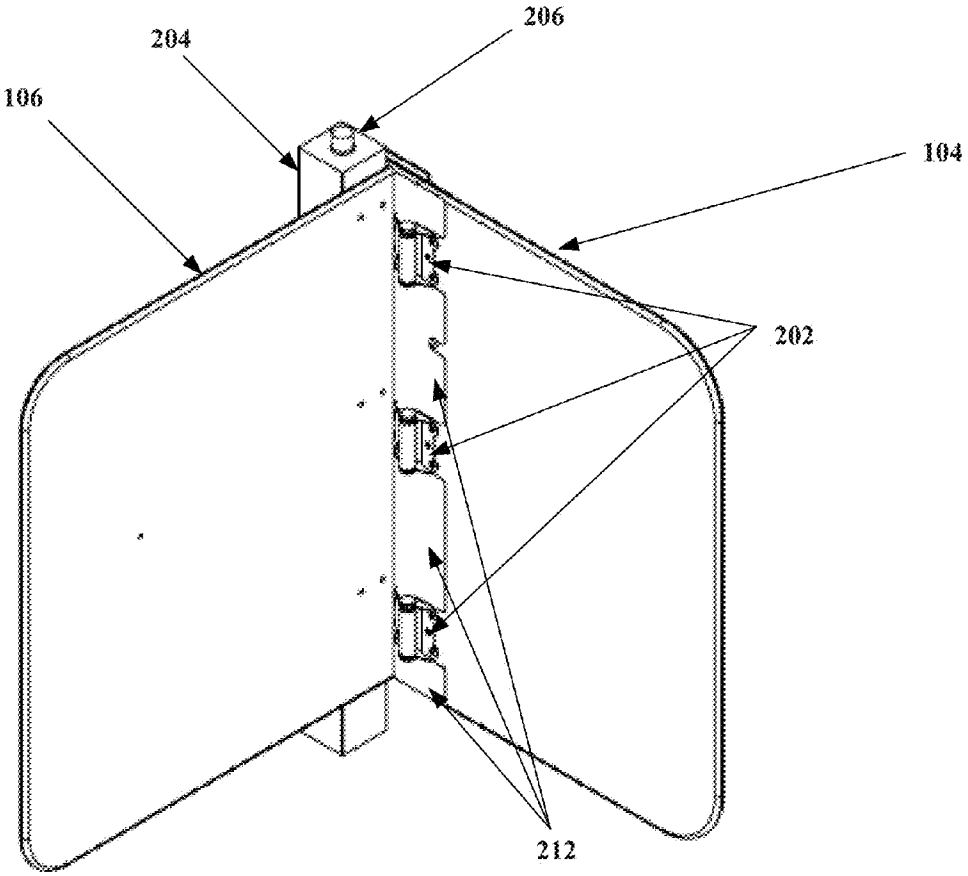
FIG. 2 is a diagram illustrating an example first panel and second panel of an automated entrance, in accordance with aspects of the present invention.
Figure 3:
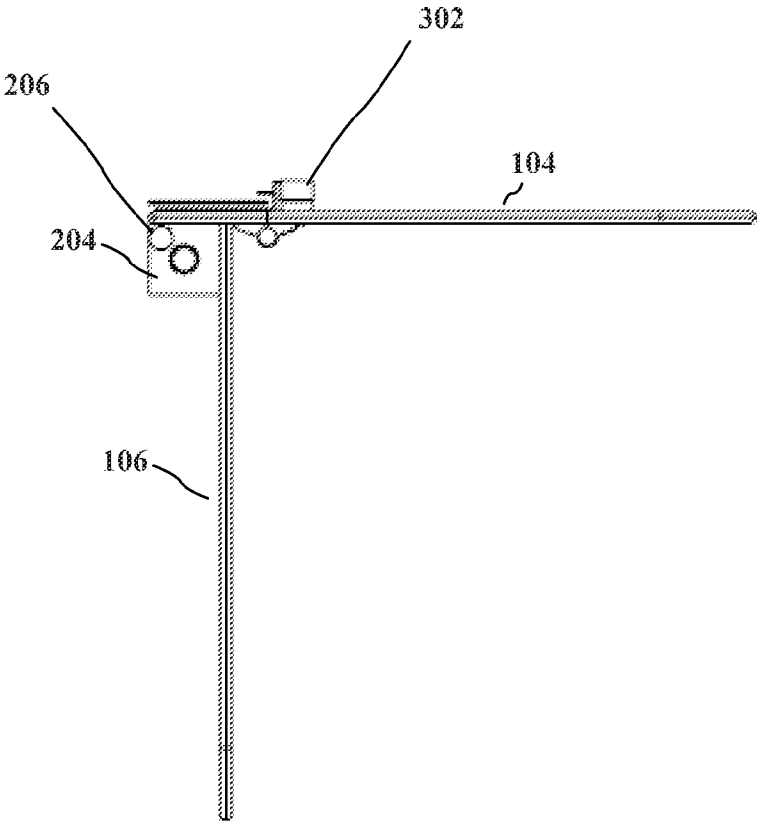
FIG. 3 is a diagram illustrating an example automated entrance, in accordance with aspects of the present invention.

FIGS. 2 and 3 illustrate the first panel 104 and the second panel 106 positioned approximately at a right angle with respect to each other, forming an "L" cross-sectional shape. The panels 104, 106 may be mounted to a central component, also referred to herein as a pivot post 204. The pivot post 204 pivots or rotates, e.g., on a bearing, to may form a pivoting or rotating portion of the automated entrance, for example. The panels 104, 106 may be coupled to the pivot post 204, e.g. using hinges 202 or other similar features that enable the panels to fold, hinge or pivot with respect to the pivot post at times. For example, during typical operation, the panels 104, 106 would remain in a locked position with respect to the pivot post 204. However, as described further herein, an exit feature may be used that allows at least one of the panels to hinge at certain times. FIG. 2 also illustrates a magnet 206 that may be used, e.g., for spin detection.

FIG. 3 illustrates a lock 302, such as a magnetic lock that may be used to maintain panel 104 in a fixed position relative to the pivot post 204 until a certain condition is met, e.g., for an exit function.

FIGS. 5A-E illustrate views of the rotation or pivoting of the panels as they operate, e.g., are pushed, to allow entrance to a participant for an example implementation. In FIGS.

Figure 5B:
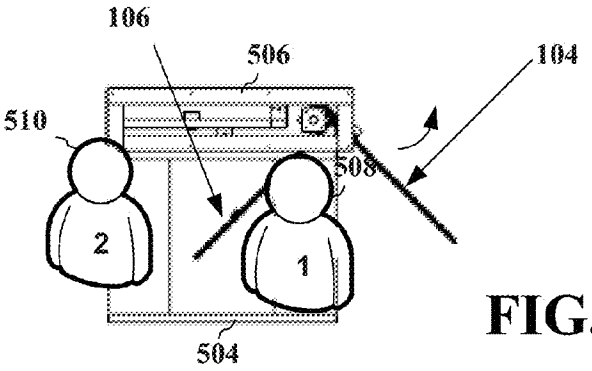
FIGS. 5A, 5B, 5C, 5D, and 5E are diagrams illustrating the operation of an automated entrance, in accordance with aspects of the present invention.
Figure 5A:
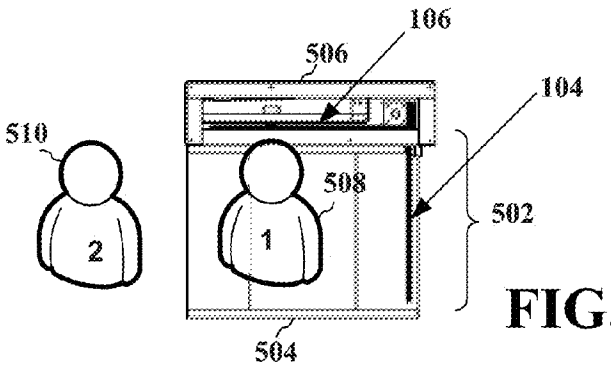

5A-5E, an entrance opening 502 may be formed between two closures, e.g., 504 and 506. The closures 504, 506 may be formed by a wall, gate, housing, or other part of the attraction or automated entrance system. For example, closure 504 may comprise a housing for the automated entrance device. FIG. 5A shows the panels in a first position, the first panel 104 closing the entrance opening 502 and the second panel 106 positioned adjacent housing 506. In the first position, the first panel 104 blocks a user 508 from passing through the entrance opening 502. Once payment or credit, for example, or other authorization for entrance is received for the user 508, the device allows the panels to rotate, such as in a fixed manner, to allow entrance only to user 508. For example, a magnetic latch may unlock to allow the user 508 to push the first panel open. FIG. 5B illustrates the rotation from the first position in FIG. 5A to the second position in FIG. 5C in order to allow entrance to user 508. The panels move together, in a fixed manner, maintaining their "L" cross-sectionally shaped position. As illustrated, the second panel 106 prevents a second user 510 from gaining unauthorized entrance to the attraction by following the first user through the entrance opening 502. The panels 104, 106 rotate to a second position, e.g., the position shown in FIG. 5C, at which point the user 508 may continue into the attraction. For example, in the second position, the second panel 106 may be positioned across the entrance opening 502 so as to prevent entrance by any unauthorized users, e.g., user 510.

Once first user 508 has passed through the entrance, the panels 104, 106 return to the first position, or otherwise reset to allow entrance to other participants. FIG. 5D illustrates the panels 104, 106 in process of rotating back to their original position after user 508 has passed through the entrance. Thus, the panels 104, 106 rotate in a first direction (e.g., counter-clockwise, as shown in FIG. 5B) to allow entrance to a user and rotate in the opposite direction (e.g., clockwise, as shown in FIG. 5D) to return to the reset position. The panels may be biased, for example, to cause the panels to return to the original position. The panels may be capable of pivoting through an approximately 90° rotation between the first position shown in FIG. 5A and the second position shown in FIG. 5C. The automated entrance may be configured to allow the user to push the panel in order to gain entrance. Thus, although the panels may be capable of rotating 90°, the user may gain access before pushing the panel through the entire 90° rotation, because the user may stop pivoting the panels as soon as the user is able to pass through the entrance.

Figure 5E:
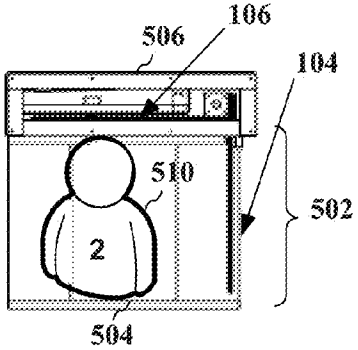
Figure 5D:
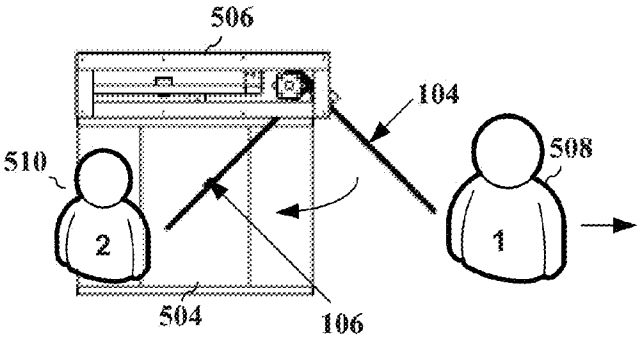
Figure 5C:
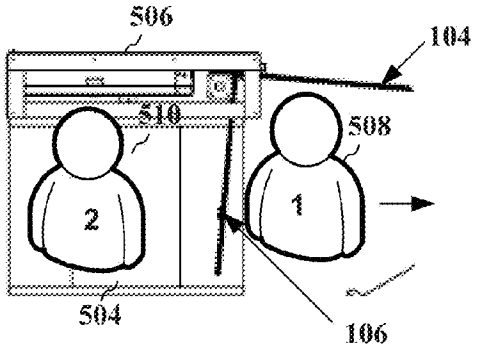

In FIG. 5E, the panels 104, 106 have returned to their original position, with the first panel 104 closing the entrance opening. At this point, the automated entrance controls access to the attraction until access authorization (e.g., payment) is received from another user (e.g., second user 510). A lock, such as a magnetic lock, may be engaged that locks the panels in this first position preventing another person from pushing the panels open to enter the attraction, until access authorization is obtained.

As the two panels may only rotate approximately 90 degrees, before resetting, they may thereby control the flow of participants, while maintaining a small footprint. Also, the automated entrance controls the entrance opening without the need for further additional panels.

The first panel and the second panel form solid coverage of at least a portion of the entrance opening, and may extend from a level near the floor to a height of approximately between 2½" to 5½. The height of the panels may be selected based on the approximate age of the anticipated participants, for example, to be around or above the waist height of the average participant. For example, for a children's attraction, a height may be selected that would tall enough to discourage teenagers from stepping over the panel yet low enough to allow parents to reach over and pick up their child. By providing full vertical coverage of an entrance opening, such an automated entrance system may control entrance to the attraction event without users comprehending the need for a particular control of participant entry. This feature can be especially advantageous for attractions targeted to children. Some of these attractions may require users to wait, so as to allow the user ahead to experience the attraction prior to entrance of the next user. By providing solid doors, children must wait to gain entrance until authorization is provided by the automated system. Additional control may be used in allowing entrance to participants. In one example, a timer may be used to further control entrance to the attraction, e.g., when a user should experience the attraction in an uninterrupted manner. In another example, the automated entrance may prevent entrance by another participant until a first participant reaches a certain stage of the attraction. This stage may be, for example, reaching the exit of the attraction.

At least one of the first panel 104 and the second panel 106 may comprise a clear, transparent, translucent, or non-opaque material that allows users to see through the panel to the other side. This feature may, for example, help younger participants feel more assurance about using the automated entrance. This feature may also be advantageous, for example, so that smaller participants are not afraid to enter the attraction. Among other material choices, the panels may comprise a clear polycarbonate material.

At times, it may be advantageous to allow participants to exit the attraction through the entrance, even when a separate exit is provided. When a participant would like to exit for any reason, an emergency exit feature may be provided on the automated entrance that allows for exit when a person is detected on the inside of the panel, but remains locked, for example, when someone exterior to the entrance is trying to pull it open. In order to allow for emergency exit, for example, one of the panels may be hinged to allow it to fold back to form an exit. The normal position of this panel may be maintained until a person attempts to exit the attraction, e.g., using a second magnetic latch, which may be triggered by sensing the presence of the person attempting to exit or by a selectable switch or other mechanism.

This exit feature may thereby allow the entrance to function as an exit. Exiting the automated entrance may involve a user pushing their way out by moving the first panel, which normally blocks the entrance.

Figure 6D:
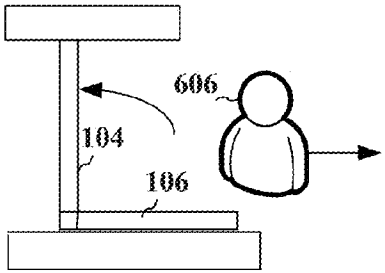
FIGS. 6A, 6B, 6C, and 6D are diagrams illustrating the operation of an exit mechanism in an automated entrance, in accordance with aspects of the present invention.
Figure 6C:
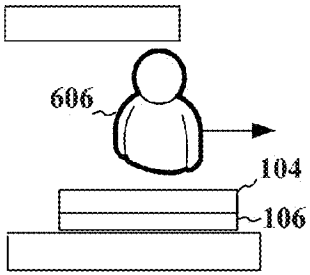
Figure 6B:
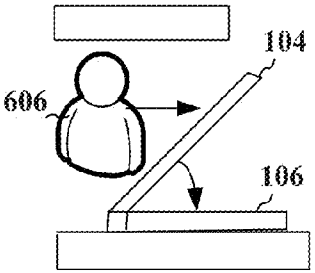
Figure 6A:
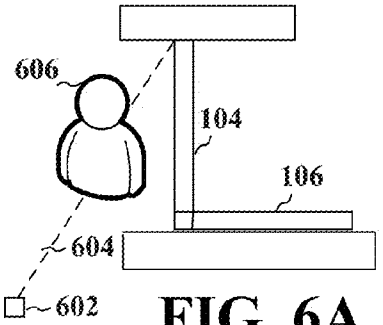

In one example, the panels may be coupled with a hinge that maintains the first panel and the second panel in a fixed position, e.g., at approximately 90 degrees in cross-section relative to each other, until a certain condition is met. Once the condition is met, the hinge allows the first panel to be moved toward the second panel to allow a user to exit the attraction. This condition may be the detection of a person attempting to exit. For example, FIGS.. 6A, 6B, 6C, and 6D illustrate an example exit mechanism. In FIG. 6A, the first panel 104 initially blocks the entrance opening, preventing anyone from entering or exiting. A mechanism may be provided to allow exit through the automated entrance device when a person wishes to exit back through the entrance opening.

For example, a sensor 602 having a sensor path 604 may be positioned to detect a user 606 positioned near the entrance, which may indicate that the user desires to exit the attraction. When a user is detected near the entrance, e.g. near the first panel 104 on the side opposite the second panel 106, the first panel 104 may be allowed to collapse against the second panel to allow the person to exit, as illustrated in FIG. 6B. This operation may occur, for example by allowing the person to push the first panel 104 toward the second panel 106. In FIG. 6C, the first panel 104 has rotated to a position so as to be relatively adjacent to the second panel 106 throughout the width of the panels 104, 106. Once the person 606 has exited through the entrance opening, the first panel 104 may return to its first position, thereby closing the entrance opening, and the panels 104, 106 may thus be returned to their original fixed position relative to each other. The first panel 104 may be biased, for example, by a spring or other biasing features, to cause it to return to the first position, e.g., the position illustrated in FIGS. 6A and 6D, once the first panel 104 is released by user 606.

Thus, the condition that triggers the automated entrance to allow the panels to collapse against each other may be a person 606 standing inside the entrance near the first panel, indicating a desire to exit. Sensor 602 may be used to determine whether a person is standing near the first panel. Once the sensor has been tripped, or detects a presence near the location of the entrance opening, a locking mechanism that normally maintains the fixed position of the first panel relative to the second panel and/or a locking mechanism that locks the first panel in a position blocking the entrance may be released. The sensor may comprise, among others, at least one of an infrared (IR) sensor, a photo sensor, a photo eye sensor, an ultrasound sensor, a floor mat sensor, a thermal sensor, and an imaging sensor. In one example, the sensor may comprise an IR sensor. A possible sensor path 410 is illustrated as path 410 in FIG. 4 and as path 604 in FIG. 6A.

Thus, this exit mechanism readily allows the panel to fold outward to allow a participant to exit from inside the entrance, but holds tight to prevent a person pulling the panel from the outside from gaining unauthorized access.

A delay may be applied upon detecting the presence near the entrance opening to minimize inadvertent or unintended operation. For example, the locking mechanism may comprise a delay upon detecting a person near the entrance. For example, the lock may be released only after about a certain number of seconds after it detects a person near the exit and be enabled for exit only for about a certain number of seconds after the sensor senses a user presence. The certain number may be approximately within the range of 0.1 to 3.5 seconds.

The automated entrance may comprise an automatic lock that maintains the first panel and the second panel in the first position, closing the entrance opening, as shown in FIG. 5A, until either an entrance fee/credit is paid (or other entrance authorization is received) or until a person is detected as attempting to exit the attraction through the entrance. A second lock may maintain the first panel and the second panel in a fixed position relative to each other until a person is detected to be attempting to exit the attraction.

Once an attraction has started or all credits have been used, for example, and the participants have stepped away from the entrance, both magnetic latches may be engaged to hold the gate in the reset position, thereby preventing other participants from entering the attraction. A similar type of magnetic latch may be used at an exit to hold an exit door closed. The exit may only be released when a person is standing close to the exit, for example. The magnetic latch at the exit may release to allow the person to exit. Once the exit door closes, the magnetic latch may hold the door closed again.

Among other locking mechanisms, these locks may comprise a magnetic lock. Magnetic locks typically require a constant source of power. Thus, as a safety feature in power outages, the locks may automatically unlock to allow emergency exit to any participants. Therefore, the lock in this example defaults to a safe mode that allows people to freely exit. Such automatic locks may be used e.g., to allow the panels to pivot to allow entrance to a user, as part of an emergency release to allow a user to exit, as part of an exit release to allow a user to exit, and for general use in the modified turnstile.

Figure 7:
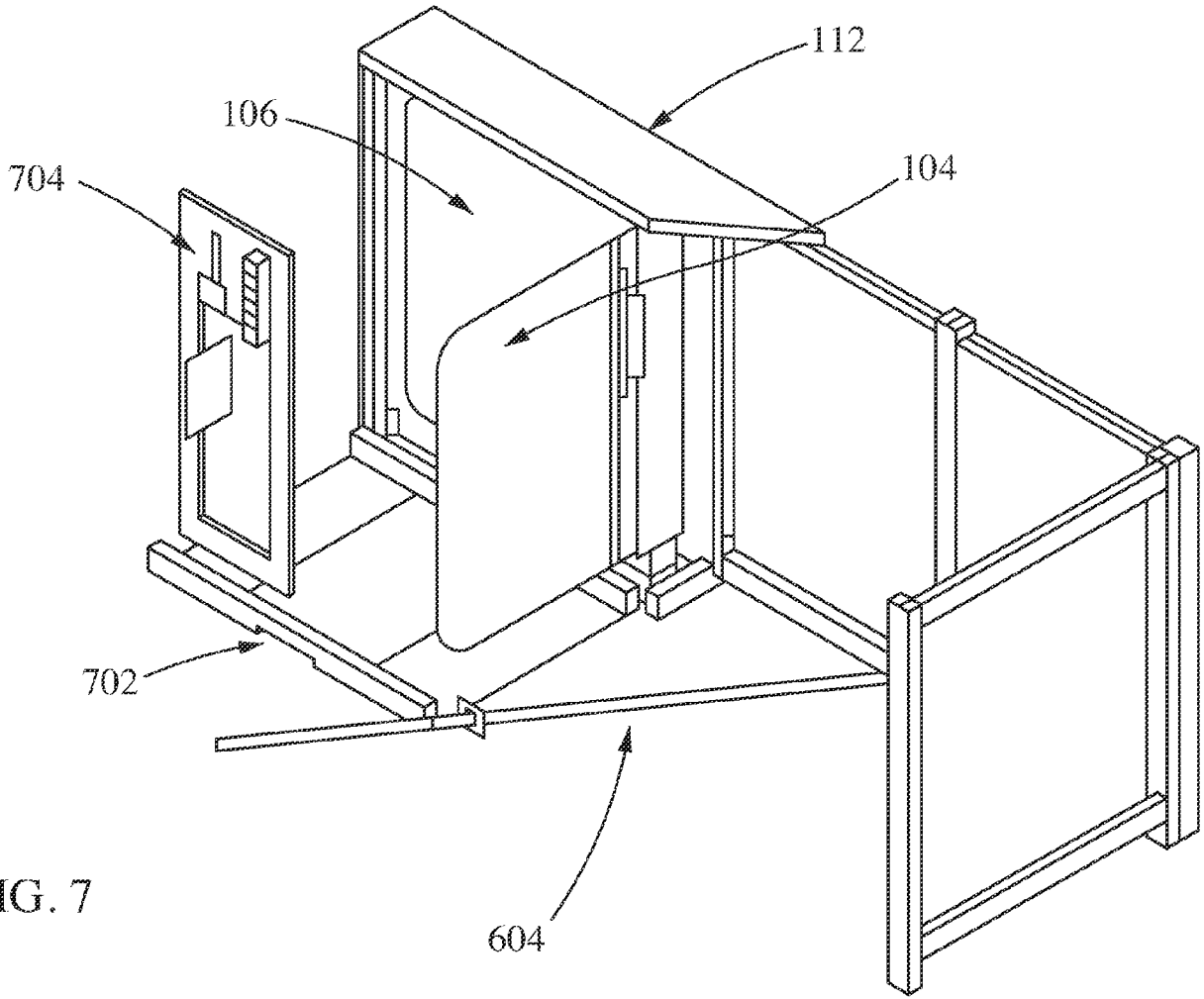
FIG. 7 is a diagram illustrating an automated entrance, in accordance with aspects of the present invention.

The automated entrance may further comprise a raised tread plate 702, as illustrated in FIG. 7. The first panel 104 and the second panel 106 may be positioned above the tread plate 702 and extend above the tread plate 702 so as to provide full coverage of the entrance. Thus, the panels 104, 106 may extend to an approximate waist height of the average participant, or for example, to a height of approximately 2.5-5.5 feet, for example between 24-34 inches, and in one example, between 32-34 inches. The raised tread plate 702 may comprise a metal material. Such a raised tread plate 702 may be positioned, e.g., under the entrance between the modified turnstile and the attraction. Thus, the tread plate 702 may extend underneath the panels of the modified turnstile, for example. A raised tread plate 702 may function to connect the modified turnstile to the attraction and to provide a covered space to run cables, power lines, and other connections underneath the tread plate 702 that may connect, for example, to the modified turnstile to enable operation. FIG. 7 also illustrates an example interface 704 for receiving credit or payment for the attraction. Once a user enters a form of credit or payment for the attraction, for example, the automated entrance device may permit the user to enter the attraction.

Figure 8:
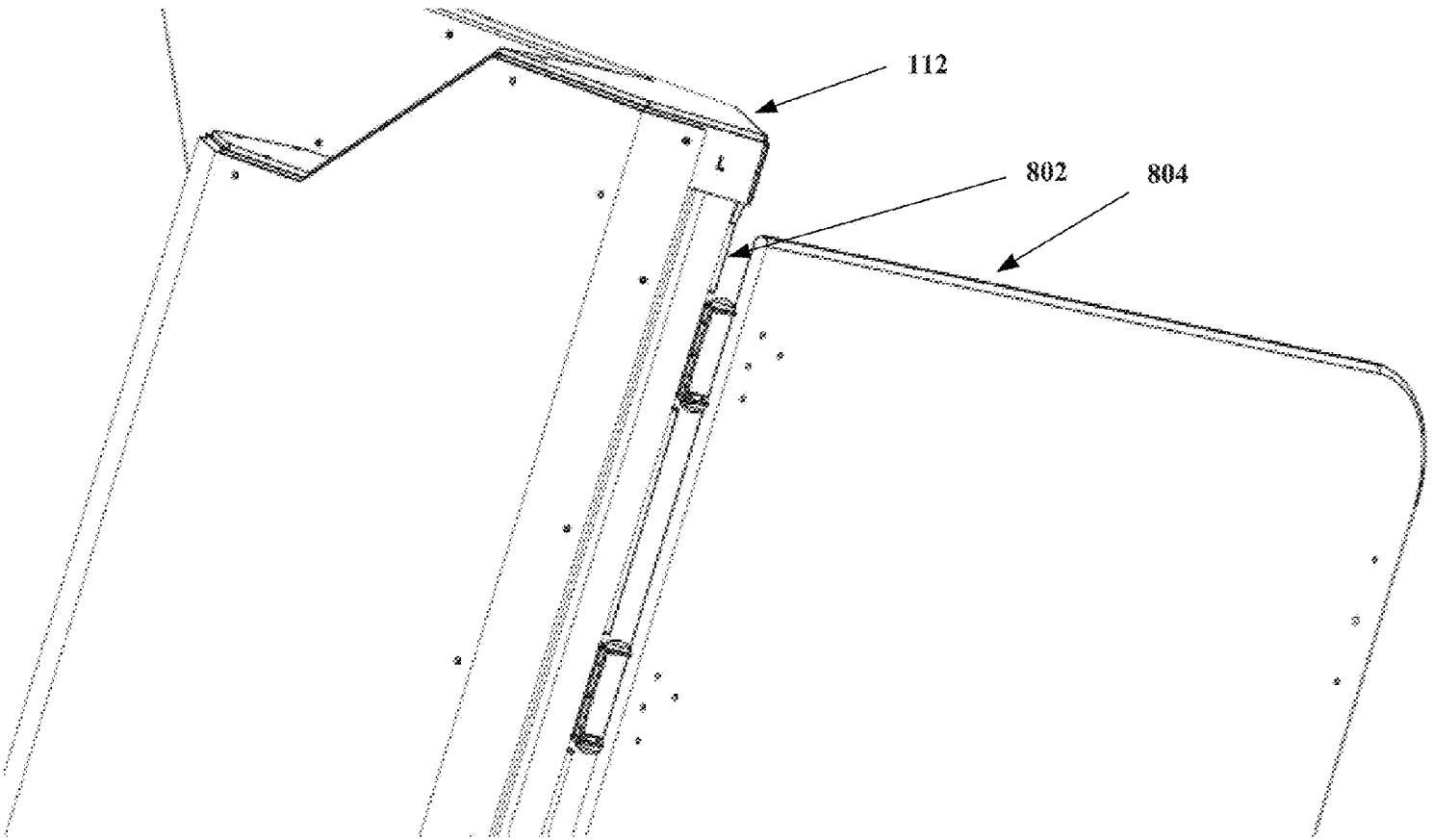
FIG. 8 is a diagram illustrating an automated entrance, in accordance with aspects of the present invention.

The automated entrance may further comprise a pinch guard as shown in FIG. 8. An opening 802 might be formed between a panel 804 (e.g., panel 804 may be the first panel 104 or the second panel 106), and the pivot housing 112. Exit panels may form a similar opening. As panel 804 rotates or pivots about its hinges, for example, this opening 802 has the potential to pinch fingers and other body parts or other items that might be inadvertently placed in this opening. This result may be especially problematic when the automated entrance is used for children's attractions. Placing a pinch guard over any areas such that hinge or pivot and may pinch thereby may reduce the chances of user injury. The pinch guard may comprise a flexible membrane positioned over each hinge or other rotating feature, see, e.g., membrane 212 illustrated in FIG. 2. Among others, the flexible membrane may comprise rubber, polycarbonate material, etc. Sliding polycarbonate sheets of plastic may be suitably provided over or about the hinged areas to prevent pinching in corners.

Hydraulically dampened springs and/or other similar mechanisms may be used on any of the panels and pivots in order to reduce the speed at which the panels swing closed after a user has pushed the panel open, passed through the entrance/exit, and/or released the panel.

At times, attractions may offer both a single player mode and a multi player mode, e.g., a two player mode, for example. Other attractions may allow a certain number of participants to enter the attraction at one time. Thus, a mechanism may be included in the automated entrance to allow multiple participant entrance. Although the following example is described in connection with two users, these aspects may be applied to any suitable predetermined number of multiple users, e.g., three, four, five, or more.

In one example, the automated entrance may comprise a sensor that detects a number of cycles of the automated entrance. A cycle may comprise the first panel and the second panel rotating from the first position to the second position and returning to the first position. Thus, the sensor may determine, for example, when two players have been permitted entrance to the attraction. A magnet or other similarly operable feature may be positioned on at least one of the pivot post, the first panel and the second panel. A sensor may be positioned, for example, on the housing of the automated entrance so that it is fixed relative to the housing and detects the magnet each time the panels rotate to allow entrance to a user. Among other types of sensors, the sensor may comprise a fixed Hall effect sensor. Once a predetermined amount of cycles have been detected, the automated entrance may lock in a closed position to prevent entrance by additional players.

Figure 9C:
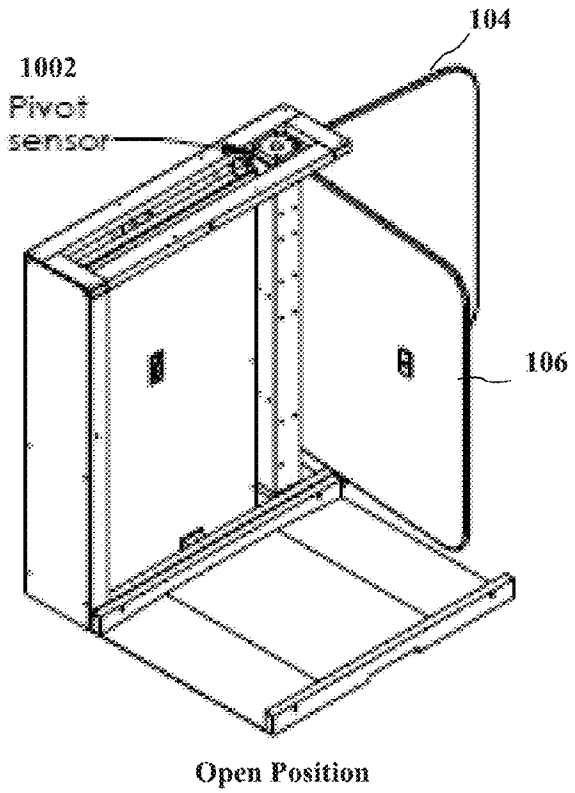
FIGS. 9A, 9B, and 9C are diagrams illustrating an automated entrance at a reset position, a partially open position, and an open position, respectively, in accordance with aspects of the present invention.
Figure 9B:
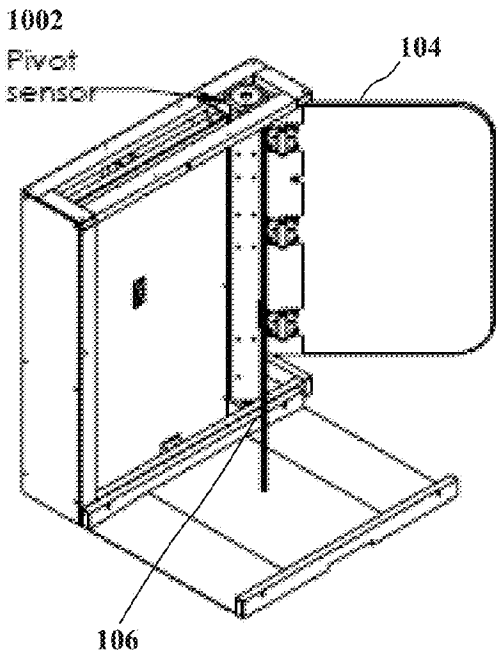
Figure 9A:
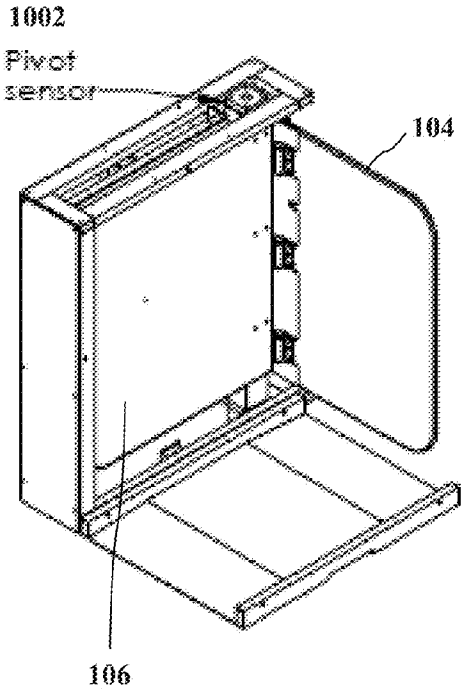
Figure 10C:
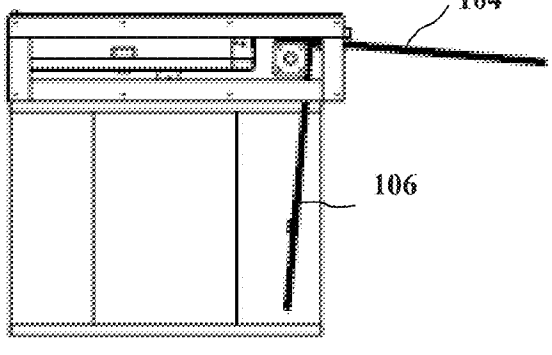
FIGS. 10A, 10B, and 10C are diagrams illustrating views from above an automated entrance at a reset position, a partially open position, and an open position, respectively, in accordance with aspects of the present invention.
Figure 10B:
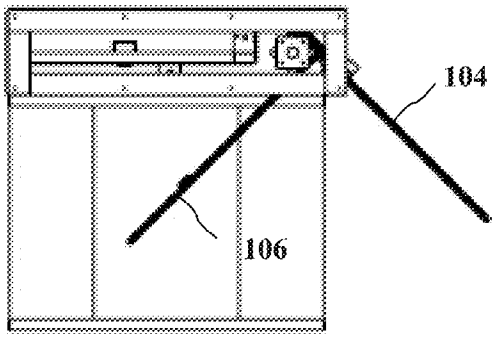
Figure 10A:
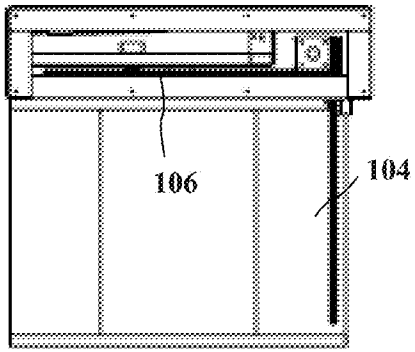

FIGS. 9A, 9B, and 9C illustrate an example location of a sensor 1002. FIGS. 9A-C illustrate a view of an example automated entrance in a reset position in FIG. 9A, in a partially open position in FIG. 9B and in a fully open position in FIG. 9C. FIGS. 10A, 10B, and 10C show a view from above the automated entrance in which the panels are at a reset position in FIG. 10A, in a partially open position in FIG. 10B and in a fully open position in FIG. 10C.

In certain aspects or uses, the automated entrance may be configured to allow only a single user entrance. The automated entrance device may likewise be configured instead to allow entrance to multiple users, as detected by the sensor, before locking the panels in the first position to prevent entrance to any additional users. Additionally, the automated entrance may be configured to offer either single user entrance or multiple user entrance based upon the amount of payment or upon another selection (e.g., by a user). For example, the user may be presented with the option for a single player mode and a multi-player mode.

Thus, for example, once payment for a single user or selection of a single player mode has been received, the system may allow the pivot to cycle once to allow a single use to enter. If additional payment or selection of a dual player mode were received instead, the system may allow the pivot to cycle twice to allow two users to enter.

For a dual-player mode, the turnstile may cycle twice to allow two players to enter. This operation may be accomplished, for example, by providing a magnet on the pivot that is sensed by a fixed Hall effect sensor. Each time the magnet swings proximally to the Hall effect sensor, for example, the sensor indicates that a player has entered the attraction. The sensor triggering magnet may simply be placed on the pivot, and its position may be adjusted in location as needed for the trip point for the sensor. If multiple credits are entered in order to allow multiple participants to experience the attraction together, a second participant and/or subsequent authorized participants may then enter by pivoting the two panels and walking through the entrance. Otherwise, the panels lock to prevent pushing of the panel open to gain entrance by unauthorized users.

Figure 4:
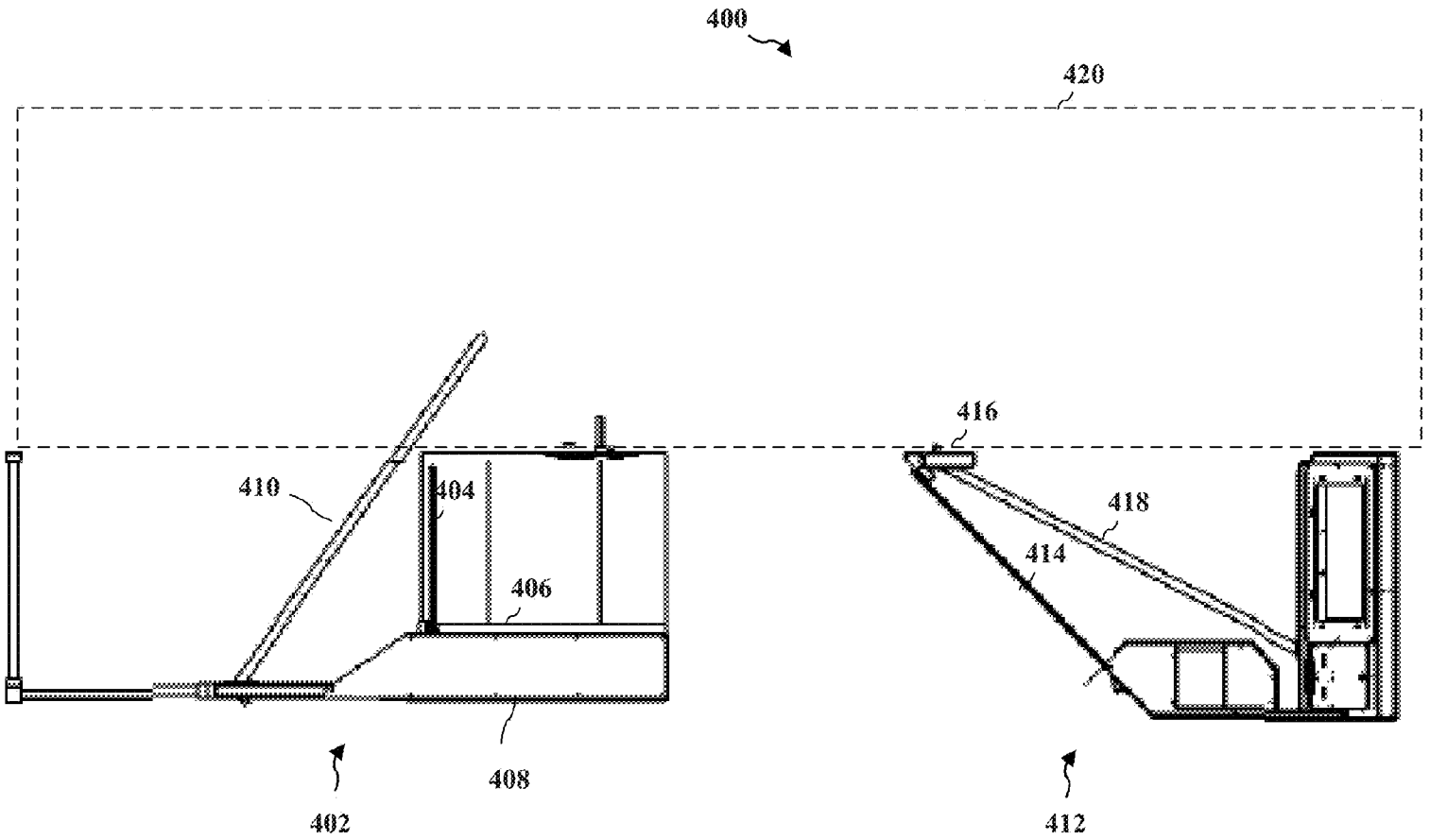
FIG. 4 is a diagram illustrating an example attraction having an automated entrance and an automated exit, in accordance with aspects of the present invention.

In addition to a controlled entrance, a controlled exit may be advantageous to prevent participants from gaining unauthorized access through the exit and interrupting the experience of authorized users. FIG. 4 illustrates an attraction 400 having an automated entrance 402 and an automated exit 412. A possible perimeter 420 for the attraction is illustrated using a dashed line. The attraction may be of any suitable size. The attraction may comprise an attraction housing having walls that enclose the attraction. Alternatively, the attraction may be an open attraction having a gate surrounding the perimeter of the attraction.

The attraction 400 may include an automated entrance device 402 at a first location of the attraction, the automated entrance having, for example a housing 408, a first panel 404 operably coupled to the housing 408, and a second panel 406 operably coupled to housing 408 at an approximately 90° angle to the first panel 404. The first panel 404 and the second panel 406 may rotate together from a first position to a second position so as to allow entrance to a user and then return to the first position. The attraction 400 may also include an automated exit 412 at a second location of the attraction. The automated exit may include a third panel 414, an automated lock, and a sensor 416 for determining when a user has approached the exit. The exit door/panel may also comprise a clear material so that younger participants may see through the door and not be afraid to pass therethrough. The automatic lock may lock the third panel, for example, until the sensor determines that a user has approached the exit. The automatic lock may comprise a magnetic latch. Sensor 416 may comprise, for example, any of the sensors described in connection with sensor 602. For example, sensor 416 may comprise an IR sensor having a sensor path 418. When released, the third panel, or exit panel, 414, for example, may be released to allow a user to push the panel open to exit the attraction. The exit panel may be allowed to rotate, for example, in an outward direction, e.g., away from the attraction. The latch may also release and allow a user to pull the panel inward toward the attraction to allow the user to exit.

A delay may be used once a person is detected. For example, a delay of approximately a few hundred milliseconds may be used, approximately in the range of 100-300 ms. Such a delay may be provided, e.g., in a sensor circuit, in order to account for a person walking past the sensor before actually opening the panel, and thus prevent unnecessary triggering of the release. Similarly, the latch may be maintained open for about 100-300 ms after a sensor is tripped and then may be re-established. A user may thus be required to somewhat deliberately pass the sensor prior to attempting to open the panel, and to immediately attempt to exit after triggering the sensor. Without such an open latch delay, when the user tries to open the panel, it would be locked again.

Example aspects of the present invention have now been described in accordance with the above advantages. It will be appreciated that these examples are merely illustrative of aspects of the present invention. Many variations and modifications will be apparent to those skilled in the art.

It is understood that the specific order or hierarchy of steps in the processes disclosed is an illustration of example approaches. Based upon design preferences, it is understood that the specific order or hierarchy of steps in the processes may be rearranged. Further, some steps may be combined or omitted. The accompanying method claims present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope thereof, consistent with the language of the claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

What is claimed is:

1. An automated entrance device, comprising:

a housing;

a first panel operably coupled to the housing;

a second panel operably coupled to the housing to form an approximately 90° angle between the first panel and the second panel, wherein the first panel and the second panel are selectively rotatable in a first direction together from a first position to a second position and return from the second position to the first position in a second direction, wherein the first panel and the second panel are operatively coupled to a single spindle such that the first panel and the second panel rotate together about the same vertical axis in the first direction when the single spindle rotates; and a hinge operably coupled between the first panel and the second panel, wherein the first panel and the second panel are maintained in a fixed position having approximately 90 degrees between the first panel and the second panel until a condition is met, and wherein when the condition is met, the first panel pivots at the hinge to move in the second direction while the second panel remains fixed.

2. The automated entrance device of claim 1, wherein in the first position, the first panel is positioned across an entrance opening, and in the second position, the second panel is positioned across the entrance opening.

3. The automated entrance device of claim 2, wherein the condition comprises a sensor detecting a user near the first panel on a side opposite the second panel.

4. The automated entrance device of claim 1, wherein the first panel and the second panel rotate in the first direction to allow entrance to a user and rotate in the second direction, opposite the first direction, to return to the first position.

5. The automated entrance device of claim 1, wherein the first panel and the second panel are configured to pivot through an approximately 90° rotation before returning to the first position.

6. The automated entrance device of claim 1, wherein the automated entrance device is positioned at an entrance with the first panel extending across the entrance in the first position, wherein the first panel and the second panel control passage of a user through the entrance without additional panels.

7. The automated entrance device of claim 1, wherein the first panel and the second panel extend from a level near a floor to a height of at least 24 inches.

8. The automated entrance device of claim 7, wherein at least one of the first panel and the second panel comprises a clear material.

9. The automated entrance device of claim 1, further comprising:

a lock that maintains the first panel and the second panel in the first position until either the condition is met or an entrance fee is received from a user.

10. The automated entrance device of claim 1, further comprising a magnetic lock that maintains the first panel and the second panel in the first position until the condition is met and that releases the first panel to allow the first panel to pivot at the hinge to move in the second direction when the condition is met.

11. The automated entrance device of claim 1, further comprising:

a raised tread plate, wherein the first panel and the second panel are positioned above the tread plate.

12. The automated entrance device of claim 1, further comprising:

a pinch guard.

13. The automated entrance device of claim 12, wherein the pinch guard comprises:

a flexible membrane that extends along a side of at least one of the first panel and the second panel adjacent the housing.

14. The automated entrance device of claim 1, further comprising:

a sensor configured to detect a number of cycles of a rotation of the first panel and the second panel of the automated entrance device.

15. The automated entrance device of claim 14, comprises:

a sensor triggering feature positioned on at least one of the first panel and the second panel, and wherein the sensor is fixed relative to the housing and detects the sensor triggering feature as the panels rotate to allow passage for a user.

16. The automated entrance device of claim 15, wherein the sensor triggering feature comprises a magnet.

17. The automated entrance device of claim 14, wherein the automated entrance device is configured to allow entrance to multiple users before locking in the first position.

* * * * *